US006382921B1

(12) United States Patent
Selig et al.

(10) Patent No.: US 6,382,921 B1
(45) Date of Patent: May 7, 2002

(54) LOW REYNOLDS NUMBER, LOW DRAG, HIGH LIFT AIRFOIL

(75) Inventors: Michael S. Selig, Mahomet, IL (US); William Holmes; Frank Stauder, both of London (CA)

(73) Assignee: Seimens VDO Automotive, Inc., Mississauga (CA)

( * ) Notice: Subject to any disclaimer, the term of this patent is extended or adjusted under 35 U.S.C. 154(b) by 0 days.

(21) Appl. No.: 09/772,367

(22) Filed: Jan. 30, 2001

(51) Int. Cl.[7] ..... F04D 29/38

(52) U.S. Cl. ..... 416/243; 416/DIG. 2; 416/DIG. 5

(58) Field of Search ..... 416/242, 243, 416/DIG. 2, DIG. 5, 223 R

(56) References Cited

U.S. PATENT DOCUMENTS 5,417,548 A * 5/1995 Tangler et al. ..... 416/223 R
5,562,420 A * 10/1996 Tangler et al. ..... 416/223 R
6,068,446 A * 5/2000 Tangler et al. ..... 416/223 R

* cited by examiner

*Primary Examiner*—Edward K. Look
*Assistant Examiner*—Ninh Nguyen

(57) ABSTRACT

Airfoils 10 having high lift to drag characteristics at low Reynolds number are disclosed. The airfoils including a leading edge 12, a trailing edge 14 spaced from the leading edge, an upper surface 16 extending from the leading edge to the trailing edge, and a lower surface 18 extending from the leading edge to the trailing edge. An airfoil designed for a tip region of a blade has a thickness in a range of 3% to 13%, a Reynolds number in a range from 120,000 to 400,000, and a maximum lift coefficient in a range from 1.0 to 1.2. An airfoil designed for a midspan region of a blade has a thickness in a range of 3% to 13%, a Reynolds number in a range from 90,000 to 200,000, and a maximum lift coefficient in a range from 1.4 to 1.6. An airfoil designed for a root region of a blade has a thickness in a range of 5% to 15%, a Reynolds number in a range from 60,000 to 120,000, and a maximum lift coefficient in a range from 1.8 to 2.0.

21 Claims, 2 Drawing Sheets

LOW REYNOLDS NUMBER, LOW DRAG, HIGH LIFT AIRFOIL

FIELD OF THE INVENTION

The invention generally relates to axial flow fans for use in cooling systems. The invention relates particularly to airfoils having low Reynolds number, low drag and high lift.

BACKGROUND OF THE INVENTION

An axial flow fan may be used to produce a flow of cooling air through the heat exchanger components of a vehicle. For example, an airflow generator used in an automotive cooling application may include an axial flow fan for moving cooling air through a liquid-to-air heat exchanger such as an engine radiator, condenser, intercooler, or combination thereof. The required flow rate of air through the fan and change in pressure across the fan vary depending upon the particular cooling application.

To provide adequate cooling, a fan should have performance characteristics which meet the flow rate and pressure rise requirements of the particular automotive application. For example, some applications impose low flow rate and high pressure rise while other applications impose high flow rate and low pressure rise requirements. The fan must also meet the dimensional constraints imposed by the automotive engine environment.

Accordingly, there is a need to provide fans having improved airfoils in the root region (approximately 90,000 Re), the midspan region (approximately 130,000 Re) and the tip region (approximately 200,000 Re) so as to have high lift to drag characteristics.

SUMMARY OF THE INVENTION

An object of the invention is to fulfill the need referred to above. In accordance with the principles of the present invention, this objective is achieved by providing airfoils that include a leading edge, a trailing edge spaced from the leading edge, an upper surface extending from the leading edge to the trailing edge, and a lower surface extending from the leading edge to the trailing edge. An airfoil designed for a tip region of a blade has a thickness in a range of 3% to 13%, a Reynolds number in a range from 120,000 to 400,000, and a maximum lift coefficient in a range from 1.0 to 1.2. An airfoil designed for a midspan region of a blade has a thickness in a range of 3% to 13%, a Reynolds number in a range from 90,000 to 200,000, and a maximum lift coefficient in a range from 1.4 to 1.6. An airfoil designed for a root region of a blade has a thickness in a range of 5% to 15%, a Reynolds number in a range from 60,000 to 120,000, and a maximum lift coefficient in a range from 1.8 to 2.0.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE PREFERRED EMBODIMENT

The present invention relates to airfoils, or blades of a fan structure. The airfoils disclosed herein are particularly useful for engine cooling axial fan applications. The present invention discloses airfoils for the root region, the midspan region and the tip region of the blade. With reference to FIG. 1–6, each airfoil has a leading edge 12, a trailing edge 14 spaced from the leading edge 12 , an upper surface 16 extending from the leading edge 12 to the trailing edge 14, and a lower surface 18 extending from the leading edge 12 to the trailing edge 14.

Figure 1:
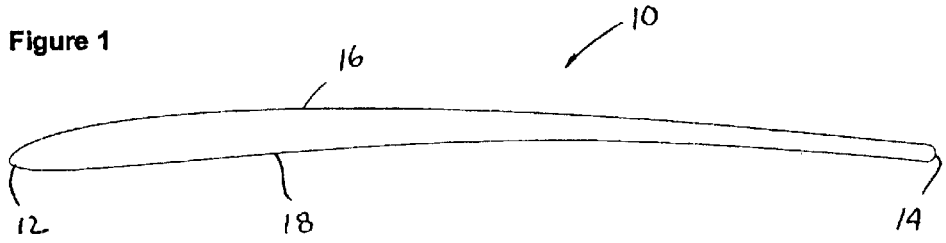
FIG. 1 is a profile of a tip region airfoil provided in accordance with the principles of a first embodiment of the present invention.
Figure 2:
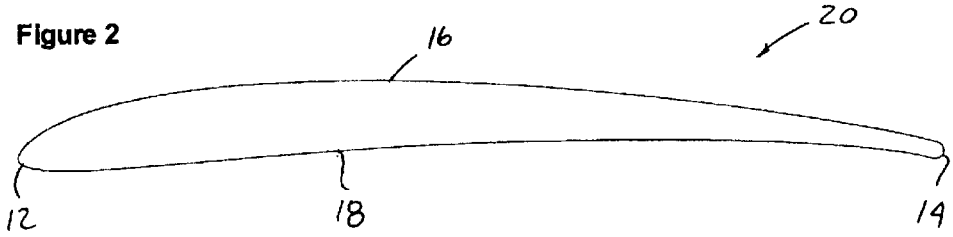
FIG. 2 is a profile of a midspan region airfoil provided in accordance with the principles of a first embodiment of the present invention.
Figure 3:
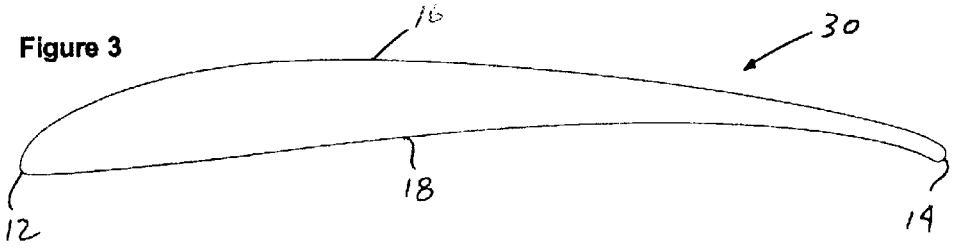
FIG. 3 is a profile of a root region airfoil provided in accordance with the principles of a first embodiment of the present invention.

In accordance with a first embodiment of the invention, airfoils designed for a tip region, midspan region, and root region, each having a rounded trailing edge, are shown respectively in FIG. 1, FIG. 2, and FIG. 3. The specific shape of the airfoil 10 of FIG. 1 for the tip region design is provided in the following table of coordinates. The airfoil 10 shown in FIG. 1 has a thickness of 5%, however, the thickness can be in the range of 3% to 13% without substantially changing the lift and drag characteristics of the airfoil 10. To reduce airfoil noise, the upper limit of the thickness range may be reduced to 7%. As defined herein, the thickness is the airfoil depth perpendicular to the camber line divided by the chord line length. The Reynolds Number is in a range of 120,000 to 400,000, with the target being 200,000 Re. The airfoil 10 has a maximum lift coefficient in a range of 1.0 to 1.2 and the lift to drag ratio has minimum sensitivity to changes in incidence angle. The trailing edge radius is about 2% of the chord length of the airfoil.

In the table below, the x/c values are x coordinates made non-dimensional by chord length, c. The y/c values are y coordinates made non-dimensional by chord length, c. The data corresponds to points defining a continuous outline from the trailing edge 14 towards the leading edge 12, starting with the upper surface 16 of the airfoil 10.

| x/c | y/c |
|---|---|
| 0.98560 | 0.01113 |
| 0.97465 | 0.01222 |
| 0.96079 | 0.01363 |
| 0.94410 | 0.01532 |
| 0.92470 | 0.01729 |

-continued

| x/c | y/c |
|---|---|
| 0.90274 | 0.01952 |
| 0.87839 | 0.02197 |
| 0.85182 | 0.02460 |
| 0.82322 | 0.02739 |
| 0.79281 | 0.03027 |
| 0.76077 | 0.03316 |
| 0.72728 | 0.03601 |
| 0.69256 | 0.03879 |
| 0.65681 | 0.04145 |
| 0.62023 | 0.04394 |
| 0.58307 | 0.04622 |
| 0.54553 | 0.04824 |
| 0.50781 | 0.04998 |
| 0.47015 | 0.05138 |
| 0.43274 | 0.05243 |
| 0.39580 | 0.05311 |
| 0.35953 | 0.05337 |
| 0.32411 | 0.05322 |
| 0.28974 | 0.05267 |
| 0.25663 | 0.05170 |
| 0.22495 | 0.05031 |
| 0.19486 | 0.04851 |
| 0.16654 | 0.04629 |
| 0.14011 | 0.04368 |
| 0.11570 | 0.04068 |
| 0.09344 | 0.03733 |
| 0.07342 | 0.03365 |
| 0.05573 | 0.02969 |
| 0.04044 | 0.02550 |
| 0.02764 | 0.02110 |
| 0.01735 | 0.01654 |
| 0.00953 | 0.01187 |
| 0.00407 | 0.00719 |
| 0.00096 | 0.00271 |
| 0.00015 | −0.00107 |
| 0.00222 | −0.00410 |
| 0.00740 | −0.00674 |
| 0.01526 | −0.00881 |
| 0.02593 | −0.01018 |
| 0.03951 | −0.01086 |
| 0.05599 | −0.01088 |
| 0.07536 | −0.01027 |
| 0.09756 | −0.00908 |
| 0.12255 | −0.00735 |
| 0.15023 | −0.00520 |
| 0.18047 | −0.00270 |
| 0.21312 | 0.00002 |
| 0.24797 | 0.00287 |
| 0.28481 | 0.00576 |
| 0.32342 | 0.00859 |
| 0.36356 | 0.01126 |
| 0.40494 | 0.01364 |
| 0.44728 | 0.01562 |
| 0.49023 | 0.01706 |
| 0.53334 | 0.01788 |
| 0.57624 | 0.01815 |
| 0.61864 | 0.01785 |
| 0.66017 | 0.01684 |
| 0.70030 | 0.01516 |
| 0.73862 | 0.01310 |
| 0.77494 | 0.01082 |
| 0.80907 | 0.00842 |
| 0.84084 | 0.00598 |
| 0.87008 | 0.00358 |
| 0.89664 | 0.00127 |
| 0.92041 | −0.00092 |
| 0.94125 | −0.00294 |
| 0.95907 | −0.00477 |
| 0.97377 | −0.00640 |
| 0.98525 | −0.00780 |
| 0.98919 | −0.00834 |
| 0.99074 | −0.00842 |
| 0.99233 | −0.00824 |
| 0.99389 | −0.00779 |
| 0.99536 | −0.00707 |
| 0.99667 | −0.00613 |
| 0.99777 | −0.00502 |

-continued

| x/c | y/c |
|---|---|
| 0.99866 | −0.00376 |
| 0.99936 | −0.00233 |
| 0.99981 | −0.00078 |
| 1.00000 | 0.00085 |
| 0.99990 | 0.00246 |
| 0.99955 | 0.00401 |
| 0.99896 | 0.00543 |
| 0.99814 | 0.00677 |
| 0.99707 | 0.00798 |
| 0.99580 | 0.00901 |
| 0.99438 | 0.00980 |
| 0.99287 | 0.01033 |
| 0.99134 | 0.01060 |

The specific shape of the airfoil 20 of FIG. 2 for the midspan region design is provided in the following table of coordinates. The airfoil 20 shown in FIG. 2 has a thickness of 8%, however, the thickness can be in the range of 3% to 13% without substantially changing the lift and drag characteristics of the airfoil 20. To ease manufacturing, the lower limit of the thickness range can be 6%, and to reduce airfoil noise, the upper limit of the thickness range can be 10%. The Reynolds number is in the range of 90,000 to 200,000 with the target being 130,000 Re. The airfoil 20 has a maximum lift coefficient of 1.4 to 1.6 and the lift to drag ratio has minimum sensitivity to changes in incidence angle. The trailing edge radius is about 2% of the chord length of the airfoil 20.

The x/c values are x coordinates made non-dimensional by chord length, c. The y/c values are y coordinates made non-dimensional by chord length, c. The data corresponds to points defining a continuous outline from the trailing edge 14 towards the leading edge 12, starting with the upper surface 16 of the airfoil 20.

| x/c | y/c |
|---|---|
| 0.98567 | 0.01360 |
| 0.97524 | 0.01627 |
| 0.96212 | 0.01928 |
| 0.94626 | 0.02259 |
| 0.92775 | 0.02621 |
| 0.90673 | 0.03012 |
| 0.88335 | 0.03427 |
| 0.85778 | 0.03860 |
| 0.83020 | 0.04305 |
| 0.80079 | 0.04757 |
| 0.76977 | 0.05207 |
| 0.73731 | 0.05647 |
| 0.70359 | 0.06070 |
| 0.66879 | 0.06471 |
| 0.63315 | 0.06846 |
| 0.59686 | 0.07190 |
| 0.56016 | 0.07497 |
| 0.52324 | 0.07760 |
| 0.48630 | 0.07977 |
| 0.44957 | 0.08141 |
| 0.41322 | 0.08248 |
| 0.37747 | 0.08299 |
| 0.34249 | 0.08289 |
| 0.30844 | 0.08216 |
| 0.27554 | 0.08082 |
| 0.24395 | 0.07886 |
| 0.21381 | 0.07627 |
| 0.18528 | 0.07306 |
| 0.15848 | 0.06924 |
| 0.13354 | 0.06485 |
| 0.11053 | 0.05993 |

-continued

| x/c | y/c |
|---|---|
| 0.08957 | 0.05451 |
| 0.07073 | 0.04866 |
| 0.05407 | 0.04246 |
| 0.03961 | 0.03595 |
| 0.02739 | 0.02925 |
| 0.01741 | 0.02250 |
| 0.00969 | 0.01586 |
| 0.00422 | 0.00950 |
| 0.00105 | 0.00362 |
| 0.00015 | −0.00137 |
| 0.00220 | −0.00521 |
| 0.00757 | −0.00829 |
| 0.01583 | −0.01075 |
| 0.02701 | −0.01243 |
| 0.04119 | −0.01337 |
| 0.05836 | −0.01360 |
| 0.07848 | −0.01315 |
| 0.10146 | −0.01208 |
| 0.12726 | −0.01045 |
| 0.15578 | −0.00836 |
| 0.18685 | −0.00593 |
| 0.22029 | −0.00326 |
| 0.25589 | −0.00044 |
| 0.29343 | 0.00243 |
| 0.33265 | 0.00525 |
| 0.37330 | 0.00793 |
| 0.41507 | 0.01036 |
| 0.45766 | 0.01244 |
| 0.50070 | 0.01404 |
| 0.54375 | 0.01513 |
| 0.58642 | 0.01580 |
| 0.62839 | 0.01610 |
| 0.66941 | 0.01614 |
| 0.70929 | 0.01592 |
| 0.74780 | 0.01534 |
| 0.78463 | 0.01436 |
| 0.81948 | 0.01296 |
| 0.85199 | 0.01117 |
| 0.88194 | 0.00900 |
| 0.90904 | 0.00651 |
| 0.93305 | 0.00375 |
| 0.95372 | 0.00080 |
| 0.97080 | −0.00230 |
| 0.98394 | −0.00532 |
| 0.98815 | −0.00647 |
| 0.98963 | −0.00675 |
| 0.99119 | −0.00679 |
| 0.99275 | −0.00656 |
| 0.99426 | −0.00607 |
| 0.99565 | −0.00534 |
| 0.99687 | −0.00442 |
| 0.99790 | −0.00334 |
| 0.99878 | −0.00206 |
| 0.99944 | −0.00063 |
| 0.99985 | 0.00090 |
| 1.00000 | 0.00247 |
| 0.99989 | 0.00401 |
| 0.99954 | 0.00547 |
| 0.99895 | 0.00688 |
| 0.99812 | 0.00821 |
| 0.99706 | 0.00939 |
| 0.99582 | 0.01038 |
| 0.99446 | 0.01113 |
| 0.99304 | 0.01164 |

The specific shape of the airfoil 30 of FIG. 3 for the root region design is provided in the following table of coordinates. The airfoil 30 shown in FIG. 3 has a thickness of 10%, however, the thickness can be in the range of range of 5% to 15% without substantially changing the lift and drag characteristics of the airfoil 30. To ease manufacturing, the lower limit of the thickness range can be 8%, and to reduce airfoil noise, the upper limit of the thickness range can be 12%. The Reynolds Number is in the range of 60,000 to 12 0,000 with a target being 90,000 Re. The airfoil 30 has a maximum lift coefficient of 1.8 to 2.0 and the lift to drag ratio has minimum sensitivity to changes in incidence angle. The trailing edge radius is about 2% of the chord length of the airfoil.

The x/c values are x coordinates made non-dimensional by chord length, c. The y/c values are y coordinates made non-dimensional by chord length, c. The data corresponds to points defining a continuous outline from the trailing edge 14 towards the leading edge 12, starting with the upper surface 16 of the airfoil 30.

| x/c | y/c |
|---|---|
| 0.99415 | 0.01353 |
| 0.98788 | 0.01756 |
| 0.97969 | 0.02207 |
| 0.96907 | 0.02665 |
| 0.95576 | 0.03142 |
| 0.93985 | 0.03641 |
| 0.92142 | 0.04159 |
| 0.90058 | 0.04690 |
| 0.87743 | 0.05231 |
| 0.85211 | 0.05776 |
| 0.82477 | 0.06321 |
| 0.79558 | 0.06861 |
| 0.76470 | 0.07392 |
| 0.73234 | 0.07909 |
| 0.69869 | 0.08406 |
| 0.66396 | 0.08880 |
| 0.62837 | 0.09326 |
| 0.59213 | 0.09740 |
| 0.55547 | 0.10117 |
| 0.51864 | 0.10455 |
| 0.48188 | 0.10748 |
| 0.44546 | 0.10991 |
| 0.40961 | 0.11177 |
| 0.37458 | 0.11295 |
| 0.34054 | 0.11336 |
| 0.30767 | 0.11290 |
| 0.27611 | 0.11152 |
| 0.24597 | 0.10900 |
| 0.21714 | 0.10535 |
| 0.18961 | 0.10079 |
| 0.16357 | 0.09546 |
| 0.13914 | 0.08940 |
| 0.11643 | 0.08269 |
| 0.09551 | 0.07548 |
| 0.07650 | 0.06782 |
| 0.05948 | 0.05982 |
| 0.04452 | 0.05161 |
| 0.03170 | 0.04328 |
| 0.02109 | 0.03499 |
| 0.01282 | 0.02674 |
| 0.00674 | 0.01853 |
| 0.00265 | 0.01065 |
| 0.00051 | 0.00345 |
| 0.00032 | −0.00269 |
| 0.00205 | −0.00679 |
| 0.00710 | −0.00870 |
| 0.01642 | −0.00937 |
| 0.02934 | −0.00928 |
| 0.04569 | −0.00854 |
| 0.06530 | −0.00726 |
| 0.08801 | −0.00554 |
| 0.11362 | −0.00343 |
| 0.14190 | −0.00100 |
| 0.17262 | 0.00174 |
| 0.20552 | 0.00480 |
| 0.24040 | 0.00838 |
| 0.27731 | 0.01251 |
| 0.31626 | 0.01692 |
| 0.35699 | 0.02140 |
| 0.39925 | 0.02579 |
| 0.44274 | 0.02992 |
| 0.48715 | 0.03362 |
| 0.53213 | 0.03676 |
| 0.57732 | 0.03921 |
| 0.62232 | 0.04083 |
| 0.66672 | 0.04154 |

-continued

| x/c | y/c |
|---|---|
| 0.71010 | 0.04126 |
| 0.75203 | 0.03996 |
| 0.79206 | 0.03761 |
| 0.82976 | 0.03426 |
| 0.86470 | 0.02997 |
| 0.89646 | 0.02484 |
| 0.92465 | 0.01901 |
| 0.94891 | 0.01264 |
| 0.96871 | 0.00587 |
| 0.98340 | −0.00065 |
| 0.98715 | −0.00266 |
| 0.98835 | −0.00319 |
| 0.98968 | −0.00355 |
| 0.99111 | −0.00369 |
| 0.99258 | −0.00359 |
| 0.99402 | −0.00325 |
| 0.99538 | −0.00266 |
| 0.99660 | −0.00188 |
| 0.99764 | −0.00093 |
| 0.99848 | 0.00012 |
| 0.99913 | 0.00125 |
| 0.99962 | 0.00250 |
| 0.99992 | 0.00388 |
| 0.99999 | 0.00533 |
| 0.99982 | 0.00680 |
| 0.99940 | 0.00822 |
| 0.99875 | 0.00954 |
| 0.99791 | 0.01070 |
| 0.99694 | 0.01168 |
| 0.99587 | 0.01245 |

Figure 4:
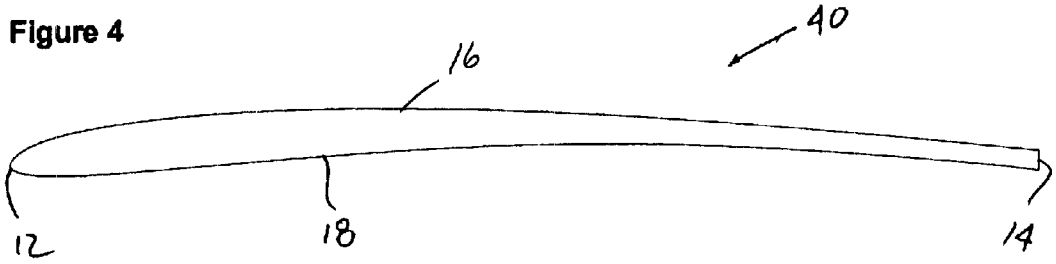
FIG. 4 is a profile of a tip region airfoil provided in accordance with the principles of a second embodiment of the present invention.
Figure 5:
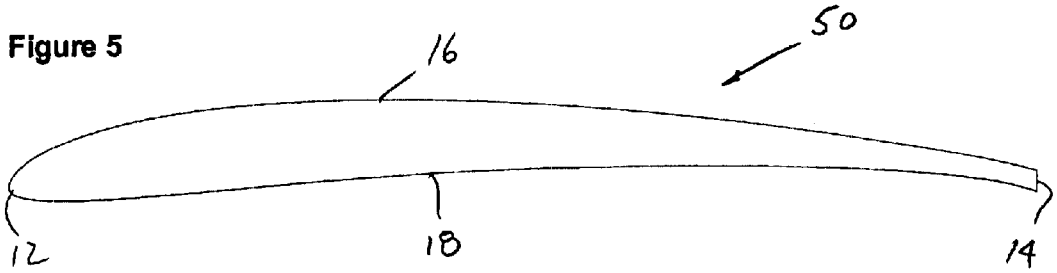
FIG. 5 is a profile of a midspan region airfoil provided in accordance with the principles of a second embodiment of the present invention.
Figure 6:
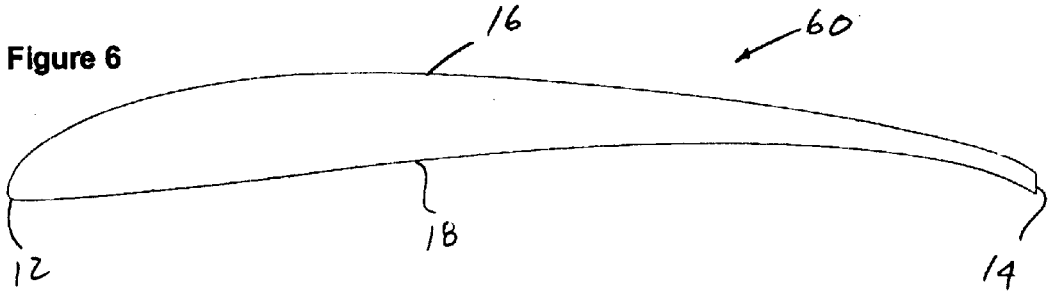
FIG. 6 is a profile of a root region airfoil provided in accordance with the principles of a second embodiment of the present invention.

In accordance with a second embodiment of the invention, airfoils designed for a tip region, a midspan region, and a root region are similar to that of the first embodiment (having the respective characteristics presented above), but each airfoil has a generally blunt trailing edge 14, as shown respectively in FIG. 4, FIG. 5, and FIG. 6.

The specific shape of the airfoil 40 of FIG. 4 for the tip region design is provided in the following table of coordinates. The x/c values are x coordinates made non-dimensional by chord length, c. The y/c values are y coordinates made non-dimensional by chord length, c. The data corresponds to points defining a continuous outline from the trailing edge 14 towards the leading edge 12, starting with the upper surface 16 of the airfoil 40.

| x/c | y/c |
|---|---|
| 1.00000 | 0.01000 |
| 0.99841 | 0.01088 |
| 0.99415 | 0.01353 |
| 0.98788 | 0.01756 |
| 0.97969 | 0.02207 |
| 0.96907 | 0.02665 |
| 0.95576 | 0.03142 |
| 0.93985 | 0.03641 |
| 0.92142 | 0.04159 |
| 0.90058 | 0.04690 |
| 0.87743 | 0.05231 |
| 0.85211 | 0.05776 |
| 0.82477 | 0.06321 |
| 0.79558 | 0.06861 |
| 0.76470 | 0.07392 |
| 0.73234 | 0.07909 |
| 0.69869 | 0.08406 |
| 0.66396 | 0.08880 |
| 0.62837 | 0.09326 |
| 0.59213 | 0.09740 |
| 0.55547 | 0.10117 |

-continued

| x/c | y/c |
|---|---|
| 0.51864 | 0.10455 |
| 0.48188 | 0.10748 |
| 0.44546 | 0.10991 |
| 0.40961 | 0.11177 |
| 0.37458 | 0.11295 |
| 0.34054 | 0.11336 |
| 0.30767 | 0.11290 |
| 0.27611 | 0.11152 |
| 0.24597 | 0.10900 |
| 0.21714 | 0.10535 |
| 0.18961 | 0.10079 |
| 0.16357 | 0.09546 |
| 0.13914 | 0.08940 |
| 0.11643 | 0.08269 |
| 0.09551 | 0.07548 |
| 0.07650 | 0.06782 |
| 0.05948 | 0.05982 |
| 0.04452 | 0.05161 |
| 0.03170 | 0.04328 |
| 0.02109 | 0.03499 |
| 0.01282 | 0.02674 |
| 0.00674 | 0.01853 |
| 0.00265 | 0.01065 |
| 0.00051 | 0.00345 |
| 0.00032 | −0.00269 |
| 0.00205 | −0.00679 |
| 0.00710 | −0.00870 |
| 0.01642 | −0.00937 |
| 0.02934 | −0.00928 |
| 0.04569 | −0.00854 |
| 0.06530 | −0.00726 |
| 0.08801 | −0.00554 |
| 0.11362 | −0.00343 |
| 0.14190 | −0.00100 |
| 0.17262 | 0.00174 |
| 0.20552 | 0.00480 |
| 0.24040 | 0.00838 |
| 0.27731 | 0.01251 |
| 0.31626 | 0.01692 |
| 0.35699 | 0.02140 |
| 0.39925 | 0.02579 |
| 0.44274 | 0.02992 |
| 0.48715 | 0.03362 |
| 0.53213 | 0.03676 |
| 0.57732 | 0.03921 |
| 0.62232 | 0.04083 |
| 0.66672 | 0.04154 |
| 0.71010 | 0.04126 |
| 0.75203 | 0.03996 |
| 0.79206 | 0.03761 |
| 0.82976 | 0.03426 |
| 0.86470 | 0.02997 |
| 0.89646 | 0.02484 |
| 0.92465 | 0.01901 |
| 0.94891 | 0.01264 |
| 0.96871 | 0.00587 |
| 0.98340 | −0.00065 |
| 0.99300 | −0.00579 |
| 0.99832 | −0.00895 |
| 1.00000 | −0.00999 |

The specific shape of the airfoil 50 of FIG. 5 for the midspan region design is provided in the following table of coordinates. The x/c values are x coordinates made non-dimensional by chord length, c. The y/c values are y coordinates made non-dimensional by chord length, c. The data corresponds to points defining a continuous outline from the trailing edge 14 towards the leading edge 12, starting with the upper surface 16 of the airfoil 50.

| x/c | y/c |
|---|---|
| 1.00000 | 0.01000 |
| 0.99831 | 0.01036 |
| 0.99343 | 0.01153 |
| 0.98567 | 0.01360 |
| 0.97524 | 0.01627 |
| 0.96212 | 0.01928 |
| 0.94626 | 0.02259 |
| 0.92775 | 0.02621 |
| 0.90673 | 0.03012 |
| 0.88335 | 0.03427 |
| 0.85778 | 0.03860 |
| 0.83020 | 0.04305 |
| 0.80079 | 0.04757 |
| 0.76977 | 0.05207 |
| 0.73731 | 0.05647 |
| 0.70359 | 0.06070 |
| 0.66879 | 0.06471 |
| 0.63315 | 0.06846 |
| 0.59686 | 0.07190 |
| 0.56016 | 0.07497 |
| 0.52324 | 0.07760 |
| 0.48630 | 0.07977 |
| 0.44957 | 0.08141 |
| 0.41322 | 0.08248 |
| 0.37747 | 0.08299 |
| 0.34249 | 0.08289 |
| 0.30844 | 0.08216 |
| 0.27554 | 0.08082 |
| 0.24395 | 0.07886 |
| 0.21381 | 0.07627 |
| 0.18528 | 0.07306 |
| 0.15848 | 0.06924 |
| 0.13354 | 0.06485 |
| 0.11053 | 0.05993 |
| 0.08957 | 0.05451 |
| 0.07073 | 0.04866 |
| 0.05407 | 0.04246 |
| 0.03961 | 0.03595 |
| 0.02739 | 0.02925 |
| 0.01741 | 0.02250 |
| 0.00969 | 0.01586 |
| 0.00422 | 0.00950 |
| 0.00105 | 0.00362 |
| 0.00015 | −0.00137 |
| 0.00220 | −0.00521 |
| 0.00757 | −0.00829 |
| 0.01583 | −0.01075 |
| 0.02701 | −0.01243 |
| 0.04119 | −0.01337 |
| 0.05836 | −0.01360 |
| 0.07848 | −0.01315 |
| 0.10146 | −0.01208 |
| 0.12726 | −0.01045 |
| 0.15578 | −0.00836 |
| 0.18685 | −0.00593 |
| 0.22029 | −0.00326 |
| 0.25589 | −0.00044 |
| 0.29343 | 0.00243 |
| 0.33265 | 0.00525 |
| 0.37330 | 0.00793 |
| 0.41507 | 0.01036 |
| 0.45766 | 0.01244 |
| 0.50070 | 0.01404 |
| 0.54375 | 0.01513 |
| 0.58642 | 0.01580 |
| 0.62839 | 0.01610 |
| 0.66941 | 0.01614 |
| 0.70929 | 0.01592 |
| 0.74780 | 0.01534 |
| 0.78463 | 0.01436 |
| 0.81946 | 0.01296 |
| 0.85199 | 0.01117 |
| 0.88194 | 0.00900 |
| 0.90904 | 0.00651 |
| 0.93305 | 0.00375 |
| 0.95372 | 0.00080 |
| 0.97080 | −0.00230 |

-continued

| x/c | y/c |
|---|---|
| 0.98394 | −0.00532 |
| 0.99302 | −0.00781 |
| 0.99829 | −0.00944 |
| 1.00000 | −0.01000 |

The specific shape of the airfoil 60 of FIG. 6 for the root region design is provided in the following table of coordinates. The x/c values are x coordinates made non-dimensional by chord length, c. The y/c values are y coordinates made non-dimensional by chord length, c. The data corresponds to points defining a continuous outline from the trailing edge 14 towards the leading edge 12, starting with the upper surface 16 of the airfoil 60.

| x/c | y/c |
|---|---|
| 1.00000 | 0.01000 |
| 0.99837 | 0.01007 |
| 0.99354 | 0.01040 |
| 0.98560 | 0.01113 |
| 0.97465 | 0.01222 |
| 0.96079 | 0.01363 |
| 0.94410 | 0.01532 |
| 0.92470 | 0.01729 |
| 0.90274 | 0.01952 |
| 0.87839 | 0.02197 |
| 0.85182 | 0.02460 |
| 0.82322 | 0.02739 |
| 0.79281 | 0.03027 |
| 0.76077 | 0.03316 |
| 0.72728 | 0.03601 |
| 0.69256 | 0.03879 |
| 0.65681 | 0.04145 |
| 0.62023 | 0.04394 |
| 0.58307 | 0.04622 |
| 0.54553 | 0.04824 |
| 0.50781 | 0.04998 |
| 0.47015 | 0.05138 |
| 0.43274 | 0.05243 |
| 0.39580 | 0.05311 |
| 0.35953 | 0.05337 |
| 0.32411 | 0.05322 |
| 0.28974 | 0.05267 |
| 0.25663 | 0.05170 |
| 0.22495 | 0.05031 |
| 0.19486 | 0.04851 |
| 0.16654 | 0.04629 |
| 0.14011 | 0.04368 |
| 0.11570 | 0.04068 |
| 0.09344 | 0.03733 |
| 0.07342 | 0.03365 |
| 0.05573 | 0.02969 |
| 0.04044 | 0.02550 |
| 0.02764 | 0.02110 |
| 0.01735 | 0.01654 |
| 0.00953 | 0.01187 |
| 0.00407 | 0.00719 |
| 0.00096 | 0.00271 |
| 0.00015 | −0.00107 |
| 0.00222 | −0.00410 |
| 0.00740 | −0.00674 |
| 0.01526 | −0.00881 |
| 0.02593 | −0.01018 |
| 0.03951 | −0.01086 |
| 0.05599 | −0.01088 |
| 0.07536 | −0.01027 |
| 0.09756 | −0.00908 |
| 0.12255 | −0.00735 |
| 0.15023 | −0.00520 |
| 0.18047 | −0.00270 |
| 0.21312 | 0.00002 |

-continued

| x/c | y/c |
|---|---|
| 0.24797 | 0.00287 |
| 0.28481 | 0.00576 |
| 0.32342 | 0.00859 |
| 0.36356 | 0.01126 |
| 0.40494 | 0.01364 |
| 0.44728 | 0.01562 |
| 0.49023 | 0.01706 |
| 0.53334 | 0.01788 |
| 0.57624 | 0.01815 |
| 0.61864 | 0.01785 |
| 0.66017 | 0.01684 |
| 0.70030 | 0.01516 |
| 0.73862 | 0.01310 |
| 0.77494 | 0.01082 |
| 0.80907 | 0.00842 |
| 0.84084 | 0.00598 |
| 0.87008 | 0.00358 |
| 0.89664 | 0.00127 |
| 0.92041 | −0.00092 |
| 0.94125 | −0.00294 |
| 0.95907 | −0.00477 |
| 0.97377 | −0.00640 |
| 0.98525 | −0.00780 |
| 0.99345 | −0.00892 |
| 0.99836 | −0.00971 |
| 1.00000 | −0.01000 |

A plurality of airfoils 10 can be arranged to define a fan structure. The fan structure can be constructed and arranged for use in an automotive cooling system, or can be configured for any application requiring movement of air.

The airfoils of the invention have high lift to drag characteristics for the associated Reynolds number ranges. These very low drag airfoils result in reduced torque and minimal motor power requirements for engine cooling axial fans. These airfoils also exhibit reduced sensitivity to changes in incident angle that will result in higher fan efficiency over a wide range of ram air conditions.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. An airfoil comprising:

a leading edge, a trailing edge spaced from the leading edge, an upper surface extending from the leading edge to the trailing edge, and a lower surface extending from the leading edge to the trailing edge, said airfoil having a thickness in a range of 3% to 13%, a Reynolds number in a range from 120,000 to 400,000, and a maximum lift coefficient in a range from 1.0 to 1.2.

2. The airfoil of claim 1, wherein the trailing edge is generally blunt.

3. The airfoil of claim 1, wherein the trailing edge has a radius equal to about 2% of a chord length of the airfoil.

4. The airfoil of claim 1, wherein the thickness is a range of 3% to 7%.

5. The airfoil of claim 1, wherein the thickness is 5%.

6. An airfoil including a leading edge, a trailing edge spaced from the leading edge, an upper surface extending from the leading edge to the trailing edge, and a lower surface extending from the leading edge to the trailing edge, wherein x/c values are dimensionless x coordinates relative to chord length, c, and y/c values are dimensionless y coordinates, relative to chord length, c, and wherein the values correspond substantially to the values in the following table:

| x/c | y/c |
|---|---|
| 0.98560 | 0.01113 |
| 0.97465 | 0.01222 |
| 0.96079 | 0.01363 |
| 0.94410 | 0.01532 |
| 0.92470 | 0.01729 |
| 0.90274 | 0.01952 |
| 0.87839 | 0.02197 |
| 0.85182 | 0.02460 |
| 0.82322 | 0.02739 |
| 0.79281 | 0.03027 |
| 0.76077 | 0.03316 |
| 0.72728 | 0.03601 |
| 0.69256 | 0.03879 |
| 0.65681 | 0.04145 |
| 0.62023 | 0.04394 |
| 0.58307 | 0.04622 |
| 0.54553 | 0.04824 |
| 0.50781 | 0.04998 |
| 0.47015 | 0.05138 |
| 0.43274 | 0.05243 |
| 0.39580 | 0.05311 |
| 0.35953 | 0.05337 |
| 0.32411 | 0.05322 |
| 0.28974 | 0.05267 |
| 0.25663 | 0.05170 |
| 0.22495 | 0.05031 |
| 0.19486 | 0.04851 |
| 0.16654 | 0.04629 |
| 0.14011 | 0.04368 |
| 0.11570 | 0.04068 |
| 0.09344 | 0.03733 |
| 0.07342 | 0.03365 |
| 0.05573 | 0.02969 |
| 0.04044 | 0.02550 |
| 0.02764 | 0.02110 |
| 0.01735 | 0.01654 |
| 0.00953 | 0.01187 |
| 0.00407 | 0.00719 |
| 0.00096 | 0.00271 |
| 0.00015 | −0.00107 |
| 0.00222 | −0.00410 |
| 0.00740 | −0.00674 |
| 0.01526 | −0.00881 |
| 0.02593 | −0.01018 |
| 0.03951 | −0.01086 |
| 0.05599 | −0.01088 |
| 0.07536 | −0.01027 |
| 0.09756 | −0.00908 |
| 0.12255 | −0.00735 |
| 0.15023 | −0.00520 |
| 0.18047 | −0.00270 |
| 0.21312 | 0.00002 |
| 0.24797 | 0.00287 |
| 0.28481 | 0.00576 |
| 0.32342 | 0.00859 |
| 0.36356 | 0.01126 |
| 0.40494 | 0.01364 |
| 0.44728 | 0.01562 |
| 0.49023 | 0.01706 |
| 0.53334 | 0.01788 |
| 0.57624 | 0.01815 |
| 0.61864 | 0.01785 |
| 0.66017 | 0.01684 |
| 0.70030 | 0.01516 |
| 0.73862 | 0.01310 |
| 0.77494 | 0.01082 |
| 0.80907 | 0.00842 |
| 0.84084 | 0.00598 |

-continued

| x/c | y/c |
|---|---|
| 0.87008 | 0.00358 |
| 0.89664 | 0.00127 |
| 0.92041 | −0.00092 |
| 0.94125 | −0.00294 |
| 0.95907 | −0.00477 |
| 0.97377 | −0.00640 |
| 0.98525 | −0.00780 |
| 0.98919 | −0.00834 |
| 0.99074 | −0.00842 |
| 0.99233 | −0.00824 |
| 0.99389 | −0.00779 |
| 0.99536 | −0.00707 |
| 0.99667 | −0.00613 |
| 0.99777 | −0.00502 |
| 0.99866 | −0.00376 |
| 0.99936 | −0.00233 |
| 0.99981 | −0.00078 |
| 1.00000 | 0.00085 |
| 0.99990 | 0.00246 |
| 0.99955 | 0.00401 |
| 0.99896 | 0.00543 |
| 0.99814 | 0.00677 |
| 0.99707 | 0.00798 |
| 0.99580 | 0.00901 |
| 0.99438 | 0.00980 |
| 0.99287 | 0.01033 |
| 0.99134 | 0.01060. |

7. An airfoil including a leading edge, a trailing edge spaced from the leading edge, an upper surface extending from the leading edge to the trailing edge, and a lower surface extending from the leading edge to the trailing edge, wherein x/c values are dimensionless x coordinates, relative to the chord length, c, and y/c values are dimensionless y coordinates, relative to the chord length, c, and wherein the values correspond substantially to the values in the following table:

| x/c | y/c |
|---|---|
| 1.00000 | 0.01000 |
| 0.99841 | 0.01088 |
| 0.99415 | 0.01353 |
| 0.98788 | 0.01756 |
| 0.97969 | 0.02207 |
| 0.96907 | 0.02665 |
| 0.95576 | 0.03142 |
| 0.93985 | 0.03641 |
| 0.92142 | 0.04159 |
| 0.90058 | 0.04690 |
| 0.87743 | 0.05231 |
| 0.85211 | 0.05776 |
| 0.82477 | 0.06321 |
| 0.79558 | 0.06861 |
| 0.76470 | 0.07392 |
| 0.73234 | 0.07909 |
| 0.69869 | 0.08406 |
| 0.66396 | 0.08880 |
| 0.62837 | 0.09326 |
| 0.59213 | 0.09740 |
| 0.55547 | 0.10117 |
| 0.51864 | 0.10455 |
| 0.48188 | 0.10748 |
| 0.44546 | 0.10991 |
| 0.40961 | 0.11177 |
| 0.37458 | 0.11295 |
| 0.34054 | 0.11336 |
| 0.30767 | 0.11290 |
| 0.27611 | 0.11152 |
| 0.24597 | 0.10900 |
| 0.21714 | 0.10535 |

-continued

| x/c | y/c |
|---|---|
| 0.18961 | 0.10079 |
| 0.16357 | 0.09546 |
| 0.13914 | 0.08940 |
| 0.11643 | 0.08269 |
| 0.09551 | 0.07548 |
| 0 07650 | 0.06782 |
| 0.05948 | 0.05982 |
| 0.04452 | 0.05161 |
| 0.03170 | 0.04328 |
| 0.02109 | 0.03499 |
| 0.01282 | 0.02674 |
| 0.00674 | 0.01853 |
| 0.00265 | 0.01065 |
| 0.00051 | 0.00345 |
| 0.00032 | −0.00269 |
| 0.00205 | −0.00679 |
| 0.00710 | −0.00870 |
| 0.01642 | −0.00937 |
| 0.02934 | −0.00928 |
| 0.04569 | −0.00854 |
| 0.06530 | −0.00726 |
| 0.08801 | −0.00554 |
| 0.11362 | −0.00343 |
| 0.14190 | −0.00100 |
| 0.17262 | 0.00174 |
| 0.20552 | 0.00480 |
| 0.24040 | 0.00838 |
| 0.27731 | 0.01251 |
| 0.31626 | 0.01692 |
| 0.35699 | 0.02140 |
| 0.39925 | 0.02579 |
| 0.44274 | 0.02992 |
| 0.48715 | 0.03362 |
| 0.53213 | 0.03676 |
| 0.57732 | 0.03921 |
| 0.62232 | 0.04083 |
| 0.66672 | 0.04154 |
| 0.71010 | 0.04126 |
| 0.75203 | 0.03996 |
| 0.79206 | 0.03761 |
| 0.82976 | 0.03426 |
| 0.86470 | 0.02997 |
| 0.89646 | 0.02484 |
| 0.92465 | 0.01901 |
| 0.94891 | 0.01264 |
| 0.96871 | 0.00587 |
| 0.98340 | −0.00065 |
| 0.99300 | −0.00579 |
| 0.99832 | −0.00895 |
| 1.00000 | −0.00999. |

8. An airfoil comprising:

a leading edge, a trailing edge spaced from the leading edge, an upper surface extending from the leading edge to the trailing edge, and a lower surface extending from the leading edge to the trailing edge, said airfoil having a thickness in a range of 3% to 13%, a Reynolds number in a range from 90,000 to 200,000, and a maximum lift coefficient in a range from 1.4 to 1.6.

9. The airfoil of claim 8, wherein the trailing edge is generally blunt.

10. The airfoil of claim 8, wherein the trailing edge has a radius equal to about 2% of a chord length of the airfoil.

11. The airfoil of claim 8, wherein the thickness is in a range of 6% to 10%.

12. The airfoil of claim 8, wherein the thickness is 8%.

13. An airfoil including a leading edge, a trailing edge spaced from the leading edge, an upper surface extending from the leading edge to the trailing edge, and a lower surface extending from the leading edge to the trailing edge, wherein x/c values are dimensionless x coordinates, relative to chord length, c, and y/c values are dimensionless y coordinates, relative to chord length, c, and wherein the values correspond substantially to the values in the following table:

| x/c | y/c |
|---|---|
| 0.98567 | 0.01360 |
| 0.97524 | 0.01627 |
| 0.96212 | 0.01928 |
| 0.94626 | 0.02259 |
| 0.92775 | 0.02621 |
| 0.90673 | 0.03012 |
| 0.88335 | 0.03427 |
| 0.85778 | 0.03860 |
| 0.83020 | 0.04305 |
| 0.80079 | 0.04757 |
| 0.76977 | 0.05207 |
| 0.73731 | 0.05647 |
| 0.70359 | 0.06070 |
| 0.66879 | 0.06471 |
| 0.63315 | 0.06846 |
| 0.59686 | 0.07190 |
| 0.56016 | 0.07497 |
| 0.52324 | 0.07760 |
| 0.48630 | 0.07977 |
| 0.44957 | 0.08141 |
| 0.41322 | 0.08248 |
| 0.37747 | 0.08299 |
| 0.34249 | 0.08289 |
| 0.30844 | 0.08216 |
| 0.27554 | 0.08082 |
| 0.24395 | 0.07886 |
| 0.21381 | 0.07627 |
| 0.18528 | 0.07306 |
| 0.15848 | 0.06924 |
| 0.13354 | 0.06485 |
| 0.11053 | 0.05993 |
| 0.08957 | 0.05451 |
| 0.07073 | 0.04866 |
| 0.05407 | 0.04246 |
| 0.03961 | 0.03595 |
| 0.02739 | 0.02925 |
| 0.01741 | 0.02250 |
| 0.00969 | 0.01586 |
| 0.00422 | 0.00950 |
| 0.00105 | 0.00362 |
| 0.00015 | −0.00137 |
| 0.00220 | −0.00521 |
| 0.00757 | −0.00829 |
| 0.01583 | −0.01075 |
| 0.02701 | −0.01243 |
| 0.04119 | −0.01337 |
| 0.05836 | −0.01360 |
| 0.07848 | −0.01315 |
| 0.10146 | −0.01208 |
| 0.12726 | −0.01045 |
| 0.15578 | −0.00836 |
| 0.18685 | −0.00593 |
| 0.22029 | −0.00326 |
| 0.25589 | −0.00044 |
| 0.29343 | 0.00243 |
| 0.33265 | 0.00525 |
| 0.37330 | 0.00793 |
| 0.41507 | 0.01036 |
| 0.45768 | 0.01244 |
| 0.50070 | 0.01404 |
| 0.54375 | 0.01513 |
| 0.58642 | 0.01580 |
| 0.62839 | 0.01610 |
| 0.66941 | 0.01614 |
| 0.70929 | 0.01592 |
| 0.74780 | 0.01534 |
| 0.78463 | 0.01436 |
| 0.81946 | 0.01296 |
| 0.85199 | 0.01117 |

-continued

| x/c | y/c |
|---|---|
| 0.88194 | 0.00900 |
| 0.90904 | 0.00651 |
| 0.93305 | 0.00375 |
| 0.95372 | 0.00080 |
| 0.97080 | −0.00230 |
| 0.98394 | −0.00532 |
| 0.98815 | −0.00647 |
| 0.98963 | −0.00675 |
| 0.99119 | −0.00679 |
| 0.99275 | −0.00656 |
| 0.99426 | −0.00607 |
| 0.99565 | −0.00534 |
| 0.99687 | −0.00442 |
| 0.99790 | −0.00334 |
| 0.99878 | −0.00206 |
| 0.99944 | −0.00063 |
| 0.99985 | 0.00090 |
| 1.00000 | 0.00247 |
| 0.99989 | 0.00401 |
| 0.99954 | 0.00547 |
| 0.99895 | 0.00688 |
| 0.99812 | 0.00821 |
| 0.99706 | 0.00939 |
| 0.99582 | 0.01038 |
| 0.99446 | 0.01113 |
| 0.99304 | 0.01164. |

14. An airfoil including a leading edge, a trailing edge spaced from the leading edge, an upper surface extending from the leading edge to the trailing edge, and a lower surface extending from the leading edge to the trailing edge, wherein x/c values are dimensionless x coordinates, relative to the chord length, c, and y/c values are dimensionless y coordinates, relative to the chord length, c, and wherein the values correspond substantially to the values in the following table:

| x/c | y/c |
|---|---|
| 1.00000 | 0.01000 |
| 0.99831 | 0.01036 |
| 0.99343 | 0.01153 |
| 0.98567 | 0.01360 |
| 0.97524 | 0.01627 |
| 0.96212 | 0.01928 |
| 0.94626 | 0.02259 |
| 0.92775 | 0.02621 |
| 0.90673 | 0.03012 |
| 0.88335 | 0.03427 |
| 0.85778 | 0.03860 |
| 0.83020 | 0.04305 |
| 0.80079 | 0.04757 |
| 0.76977 | 0.05207 |
| 0.73731 | 0.05647 |
| 0.70359 | 0.06070 |
| 0.66879 | 0.06471 |
| 0.63315 | 0.06846 |
| 0.59686 | 0.07190 |
| 0.56016 | 0.07497 |
| 0.52324 | 0.07760 |
| 0.48630 | 0.07977 |
| 0.44957 | 0.08141 |
| 0.41322 | 0.08248 |
| 0.37747 | 0.08299 |
| 0.34249 | 0.08289 |
| 0.30844 | 0.08216 |
| 0.27554 | 0.08082 |
| 0.24395 | 0.07886 |
| 0.21381 | 0.07627 |
| 0.18528 | 0.07306 |
| 0.15848 | 0.06924 |

-continued

| x/c | y/c |
|---|---|
| 0.13354 | 0.06485 |
| 0.11053 | 0.05993 |
| 0.08957 | 0.05451 |
| 0.07073 | 0.04866 |
| 0.05407 | 0.04246 |
| 0.03961 | 0.03595 |
| 0.02739 | 0.02925 |
| 0.01741 | 0.02250 |
| 0.00969 | 0.01586 |
| 0.00422 | 0.00950 |
| 0.00105 | 0.00362 |
| 0.00015 | −0.00137 |
| 0.00220 | −0.00521 |
| 0.00757 | −0.00829 |
| 0.01583 | −0.01075 |
| 0.02701 | −0.01243 |
| 0.04119 | −0.01337 |
| 0.05836 | −0.01360 |
| 0.07848 | −0.01315 |
| 0.10146 | −0.01208 |
| 0.12726 | −0.01045 |
| 0.15578 | −0.00836 |
| 0.18685 | −0.00593 |
| 0.22029 | −0.00326 |
| 0.25589 | −0.00044 |
| 0.29343 | 0.00243 |
| 0.33265 | 0.00525 |
| 0.37330 | 0.00793 |
| 0.41507 | 0.01036 |
| 0.45766 | 0.01244 |
| 0.50070 | 0.01404 |
| 0.54375 | 0.01513 |
| 0.58642 | 0.01580 |
| 0.62839 | 0.01610 |
| 0.66941 | 0.01614 |
| 0.70929 | 0.01592 |
| 0.74780 | 0.01534 |
| 0.78463 | 0.01436 |
| 0.81946 | 0.01296 |
| 0.85199 | 0.01117 |
| 0.88194 | 0.00900 |
| 0.90904 | 0.00651 |
| 0.93305 | 0.00375 |
| 0.95372 | 0.00080 |
| 0.97080 | −0.00230 |
| 0.98394 | −0.00532 |
| 0.99302 | −0.00781 |
| 0.99829 | −0.00944 |
| 1.00000 | −0.01000. |

15. An airfoil comprising:

a leading edge, a trailing edge spaced from the leading edge, an upper surface extending from the leading edge to the trailing edge, and a lower surface extending from the leading edge to the trailing edge, said airfoil having a thickness in a range of 5% to 15%, a Reynolds number in a range from 60,000 to 120,000, and a maximum lift coefficient in a range from 1.8 to 2.0.

16. The airfoil of claim 15, wherein the trailing edge is generally blunt.

17. The airfoil of claim 15, wherein the trailing edge has a radius equal to about 2% of a chord length of the airfoil.

18. The airfoil of claim 15, wherein the thickness is in a range of 8% to 12%.

19. The airfoil of claim 15, wherein the thickness is 10%.

20. An airfoil including a leading edge, a trailing edge spaced from the leading edge, an upper surface extending from the leading edge to the trailing edge, and a lower surface extending from the leading edge to the trailing edge, wherein x/c values are dimensionless x coordinates, relative to the chord length, c, and y/c values are dimensionless y coordinates, relative to the chord length, c, and wherein the values correspond substantially to the values in the following table:

| x/c | y/c |
|---|---|
| 0.99415 | 0.01353 |
| 0.98788 | 0.01756 |
| 0.97969 | 0.02207 |
| 0.96907 | 0.02665 |
| 0.95576 | 0.03142 |
| 0.93985 | 0.03641 |
| 0.92142 | 0.04159 |
| 0.90058 | 0.04690 |
| 0.87743 | 0.05231 |
| 0.85211 | 0.05776 |
| 0.82477 | 0.06321 |
| 0.79558 | 0.06861 |
| 0.76470 | 0.07392 |
| 0.73234 | 0.07909 |
| 0.69869 | 0.08406 |
| 0.66396 | 0.08880 |
| 0.62837 | 0.09326 |
| 0.59213 | 0.09740 |
| 0.55547 | 0.10117 |
| 0.51864 | 0.10455 |
| 0.48188 | 0.10748 |
| 0.44546 | 0.10991 |
| 0.40961 | 0.11177 |
| 0.37458 | 0.11295 |
| 0.34054 | 0.11336 |
| 0.30767 | 0.11290 |
| 0.27611 | 0.11152 |
| 0.24597 | 0.10900 |
| 0.21714 | 0.10535 |
| 0.18961 | 0.10079 |
| 0.16357 | 0.09546 |
| 0.13914 | 0.08940 |
| 0.11643 | 0.08269 |
| 0.09551 | 0.07548 |
| 0.07650 | 0.06782 |
| 0.05948 | 0.05982 |
| 0.04452 | 0.05161 |
| 0.03170 | 0.04328 |
| 0.02109 | 0.03499 |
| 0.01282 | 0.02674 |
| 0.00674 | 0.01853 |
| 0.00265 | 0.01065 |
| 0.00051 | 0.00345 |
| 0.00032 | −0.00269 |
| 0.00205 | −0.00679 |
| 0.00710 | −0.00870 |
| 0.01642 | −0.00937 |
| 0.02934 | −0.00928 |
| 0.04569 | −0.00854 |
| 0.06530 | −0.00726 |
| 0.08801 | −0.00554 |
| 0.11362 | −0.00343 |
| 0.14190 | −0.00100 |
| 0.17262 | 0.00174 |
| 0.20552 | 0.00480 |
| 0.24040 | 0.00838 |
| 0.27731 | 0.01251 |
| 0.31626 | 0.01692 |
| 0.35699 | 0.02140 |
| 0.39925 | 0.02579 |
| 0.44274 | 0.02992 |
| 0.48715 | 0.03362 |
| 0.53213 | 0.03676 |
| 0.57732 | 0.03921 |
| 0.62232 | 0.04083 |
| 0.66672 | 0.04154 |
| 0.71010 | 0.04126 |
| 0.75203 | 0.03996 |
| 0.79206 | 0.03761 |
| 0.82976 | 0.03426 |

-continued

| x/c | y/c |
|---|---|
| 0.86470 | 0.02997 |
| 0.89646 | 0.02484 |
| 0.92465 | 0.01901 |
| 0.94891 | 0.01264 |
| 0.96871 | 0.00587 |
| 0.98340 | −0.00065 |
| 0.98715 | −0.00266 |
| 0.98835 | −0.00319 |
| 0.98968 | −0.00355 |
| 0.99111 | −0.00369 |
| 0.99258 | −0.00359 |
| 0.99402 | −0.00325 |
| 0.99538 | −0.00266 |
| 0.99660 | −0.00188 |
| 0.99764 | −0.00093 |
| 0.99848 | 0.00012 |
| 0.99913 | 0.00125 |
| 0.99962 | 0.00250 |
| 0.99992 | 0.00388 |
| 0.99999 | 0.00533 |
| 0.99982 | 0.00680 |
| 0.99940 | 0.00822 |
| 0.99875 | 0.00954 |
| 0.99791 | 0.01070 |
| 0.99694 | 0.01168 |
| 0.99587 | 0.01245. |

21. An airfoil including a leading edge, a trailing edge spaced from the leading edge, an upper surface extending from the leading edge to the trailing edge, and a lower surface extending from the leading edge to the trailing edge, wherein x/c values are dimensionless x coordinates, relative to the chord length, c, and y/c values are dimensionless y coordinates, relative to the chord length, c, and wherein the values correspond substantially to the values in the following table:

| x/c | y/c |
|---|---|
| 1.00000 | 0.01000 |
| 0.99837 | 0.01007 |
| 0.99354 | 0.01040 |
| 0.98560 | 0.01113 |
| 0.97465 | 0.01222 |
| 0.96079 | 0.01363 |
| 0.94410 | 0.01532 |
| 0.92470 | 0.01729 |
| 0.90274 | 0.01952 |
| 0.87839 | 0.02197 |
| 0.85182 | 0.02460 |
| 0.82322 | 0.02739 |
| 0.79281 | 0.03027 |
| 0.76077 | 0.03316 |
| 0.72728 | 0.03601 |
| 0.69256 | 0.03879 |
| 0.65681 | 0.04145 |
| 0.62023 | 0.04394 |
| 0.58307 | 0.04622 |
| 0.54553 | 0.04824 |
| 0.50781 | 0.04998 |

-continued

| x/c | y/c |
|---|---|
| 0.47015 | 0.05138 |
| 0.43274 | 0.05243 |
| 0.39580 | 0.05311 |
| 0.35953 | 0.05337 |
| 0.32411 | 0.05322 |
| 0.28974 | 0.05267 |
| 0.25663 | 0.05170 |
| 0.22495 | 0.05031 |
| 0.19486 | 0.04851 |
| 0.16654 | 0.04629 |
| 0.14011 | 0.04368 |
| 0.11570 | 0.04068 |
| 0.09344 | 0.03733 |
| 0.07342 | 0.03365 |
| 0.05573 | 0.02969 |
| 0.04044 | 0.02550 |
| 0.02764 | 0.02110 |
| 0.01735 | 0.01654 |
| 0.00953 | 0.01187 |
| 0.00407 | 0.00719 |
| 0.00096 | 0.00271 |
| 0.00015 | −0.00107 |
| 0.00222 | −0.00410 |
| 0.00740 | −0.00674 |
| 0.01526 | −0.00881 |
| 0.02593 | −0.01018 |
| 0.03951 | −0.01086 |
| 0.05599 | −0.01088 |
| 0.07536 | −0.01027 |
| 0.09756 | −0.00908 |
| 0.12255 | −0.00735 |
| 0.15023 | −0.00520 |
| 0.18047 | −0.00270 |
| 0.21312 | 0.00002 |
| 0.24797 | 0.00287 |
| 0.28481 | 0.00576 |
| 0.32342 | 0.00859 |
| 0.36356 | 0.01126 |
| 0.40494 | 0.01364 |
| 0.44728 | 0.01562 |
| 0.49023 | 0.01706 |
| 0.53334 | 0.01788 |
| 0.57624 | 0.01815 |
| 0.61864 | 0.01785 |
| 0.66017 | 0.01684 |
| 0.70030 | 0.01516 |
| 0.73862 | 0.01310 |
| 0.77494 | 0.01082 |
| 0.80907 | 0.00842 |
| 0.84084 | 0.00598 |
| 0.87008 | 0.00358 |
| 0.89664 | 0.00127 |
| 0.92041 | −0.00092 |
| 0.94125 | −0.00294 |
| 0.95907 | −0.00477 |
| 0.97377 | −0.00640 |
| 0.98525 | −0.00780 |
| 0.99345 | −0.00892 |
| 0.99836 | −0.00971 |
| 1.00000 | −0.01000 . |

* * * * *